US006942142B2

(12) United States Patent
Barmettler et al.

(10) Patent No.: US 6,942,142 B2
(45) Date of Patent: Sep. 13, 2005

(54) VOTING BALLOT, VOTING MACHINE, AND ASSOCIATED METHODS

(75) Inventors: James W Barmettler, Corvallis, OR (US); Kevin G. Currans, Philomath, OR (US); Sally Kaneshiro, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 320 days.

(21) Appl. No.: 09/970,421

(22) Filed: Oct. 2, 2001

(65) Prior Publication Data

US 2003/0062408 A1 Apr. 3, 2003

(51) Int. Cl.[7] ..... G07C 13/00
(52) U.S. Cl. ..... 235/51; 235/386; 705/12
(58) Field of Search ..... 235/51, 386, 50 B, 235/54 F, 54 E, 55 A, 470, 380, 382, 435, 462.01; 705/12, 76; 434/306

(56) References Cited

U.S. PATENT DOCUMENTS

| | | | | | |
|---|---|---|---|---|---|
| 3,934,793 | A | | 1/1976 | O'Neal et al. | 235/51 |
| 3,947,669 | A | | 3/1976 | Simmons et al. | 235/156 |
| 3,971,914 | A | | 7/1976 | O'Neal et al. | 235/54 R |
| 4,025,757 | A | | 5/1977 | McKay et al. | 235/54 F |
| 4,236,066 | A | | 11/1980 | Olmstead et al. | 235/51 |
| 4,362,925 | A | | 12/1982 | Paloian et al. | 235/51 |
| 4,641,240 | A | | 2/1987 | Boram | 364/409 |
| 4,641,241 | A | | 2/1987 | Boram | 364/409 |
| 5,072,999 | A | | 12/1991 | Trotta et al. | 312/249 |
| 5,189,288 | A | * | 2/1993 | Anno et al. | 235/386 |
| 5,206,486 | A | | 4/1993 | Stephens et al. | 235/51 |
| 5,218,528 | A | * | 6/1993 | Wise et al. | 705/12 |
| 5,278,753 | A | * | 1/1994 | Graft, III | 705/12 |
| 5,412,727 | A | * | 5/1995 | Drexler et al. | 713/186 |
| 5,495,532 | A | | 2/1996 | Kilian et al. | 360/30 |
| 5,497,318 | A | | 3/1996 | Miyagawa et al. | 364/409 |
| 5,583,329 | A | | 12/1996 | Davis, III et al. | 235/50 |
| 5,585,612 | A | | 12/1996 | Harp, Jr. | 235/51 |
| 5,610,383 | A | | 3/1997 | Chumbley | 235/366 |
| 5,666,765 | A | | 9/1997 | Sarner et al. | 52/361 |
| 5,732,222 | A | | 3/1998 | Miyagawa et al. | 395/212 |
| 5,758,325 | A | * | 5/1998 | Lohry et al. | 705/12 |
| 5,821,508 | A | * | 10/1998 | Willard | 235/51 |
| 5,875,432 | A | | 2/1999 | Sehr | 705/12 |
| 5,878,399 | A | | 3/1999 | Peralto | 705/12 |
| 6,081,793 | A | | 6/2000 | Challener et al. | 705/50 |
| 6,092,051 | A | * | 7/2000 | Kilian et al. | 705/12 |
| 6,250,548 | B1 | * | 6/2001 | McClure et al. | 235/51 |

(Continued)

OTHER PUBLICATIONS

'Electronic Voting Technology—Can We Be Spared a Repeat of Election 2000' by Robert Bellinger, Feb. 2001 PPTE Feature—Electronic Voting Technology, pp 4; printed from IEE–USA Policy Perspectives, from the web http://www.todaysengineer.org/policyperspectives/feb_01features/evoting.html on Sep. 14, 2001.

*Primary Examiner*—Thien M. Le
*Assistant Examiner*—Edwyn Labaze

(57) ABSTRACT

A voting ballot is provided that comprises a number of selection areas positioned thereon. The voting ballot also includes a ballot specification embodied in a two dimensional bar code and a number of coordinates included in the ballot specification. Each of the coordinates indicates a position of one of the selection areas on the voting ballot relative to a predefined point on the voting ballot. Also, the voting ballot includes at least one contest identified in the ballot specification, wherein at least one of the selection areas is associated with the at least one contest. In addition, the present invention provides for a voting machine and method for tabulating and storing votes cast on the voting ballot as well as a system and method for creating the voting ballot.

10 Claims, 11 Drawing Sheets

U.S. PATENT DOCUMENTS 6,412,692 B1 * 7/2002 Miyagawa ..... 235/382
6,457,643 B1 * 10/2002 Way ..... 235/462.01
6,581,824 B1 * 6/2003 McClure et al. ..... 235/51
6,779,727 B2 * 8/2004 Warther ..... 235/462.01
2002/0066780 A1 * 6/2002 Balolia ..... 235/51
2002/0078358 A1 * 6/2002 Neff et al. ..... 713/176
2002/0084325 A1 * 7/2002 Reardon ..... 235/386
2002/0087394 A1 * 7/2002 Zhang ..... 705/12
2002/0161628 A1 * 10/2002 Lane Poor et al. ..... 705/12
2002/0169756 A1 * 11/2002 Biddulph ..... 707/3
2003/0006282 A1 * 1/2003 Vadura et al. ..... 235/386
2003/0042731 A1 * 3/2003 Li ..... 283/5
2003/0158775 A1 * 8/2003 Chaum ..... 705/12

* cited by examiner

```
<?xml version="1.0" encoding="utf-8"?>
<Ballot ID=23423424>                                                    119
        <ElectionDate>11-07-2000</ElectionDate>
        <Location>
                <City>Corvallis</City>
                <State>Oregon</State>                                   116
        </Location>                     133     136     139
        <BallotItem type="candidate" id="US President" regionType="Federal" regionID="US" voteFor="1">
                <Box DX="50" DY="0" BoxWidth="10" BoxHeight="10">                                143
                        <Name>Bush, George</Name>
                        <Party>Republican</Party>
                </Box>                                  113
103             <Box DX="50" DY="0" BoxWidth="10" BoxHeight="10">
                        <Name>Gore, Al</Name>
                        <Party>Democrat</Party>
                </Box>
        </BallotItem>
        <BallotItem type="candidate" id="County Sheriff" regionType="County" regionID="Benton"
                voteFor="1">
                <Box DX="50" DY="0" BoxWidth="10" BoxHeight="10">
                        <Name>Wayne, John</Name>
                        <Party>Democrat</Party>                         126
103             </Box>          DX      DY      129
                <Box DX="50" DY="0" BoxWidth="10" BoxHeight="10">
                        <Name>Wayne, Bruce</Name>
                        <Party>Republican</Party>
                </Box>
        </BallotItem>
        <BallotItem type="proposition" id="Proposition 219" regionType="Local" RegionID="Corvallis"
                voteFor="1">
                <Box DX="50" DY="0" BoxWidth="10" BoxHeight="10">
                        <Name>Yes</Name>
103             </Box>
                <Box DX="50" DY="0" BoxWidth="10" BoxHeight="10">
                        <Name>No</Name>
                </Box>
        </BallotItem>
        <BallotItem type="candidate" id="Judge" regionType="County" regionID="Benton" voteFor="1">
                <Box DX="50" DY="0" BoxWidth="10" BoxHeight="10">
                        <Name>Kent, Clark</Name>
                        <Party>Republican</Party>
                </Box>
                <Box DX="50" DY="0" BoxWidth="10" BoxHeight="10">
                        <Name>Luther, Lex</Name>
                        <Party>Republican</Party>
103             </Box>
                <Box DX="50" DY="0" BoxWidth="10" BoxHeight="10">
                        <Name>Lane, Lois</Name>
                        <Party>Republican</Party>
                </Box>
                <Box DX="50" DY="0" BoxWidth="10" BoxHeight="10">
                        <Name>Smith, Jimmy</Name>
                        <Party>Democrat</Party>
                </Box>
        </BallotItem>
</Ballot>
```

106a

FIG. 3

VOTE CONFIRMATION

Please review your selections below. If the selections indicated below are unacceptable to you for any reason, then press the "Reject" button and instructions will be provided so that you can cast a new vote. If the selections indicated below are acceptable to you, then press the "Accept" button to count your vote. Note that any selections that are blinking below indicate that you have made a mistake that resulted in an invalid decision.

236 233

1. President: INVALID

Reason: Your ballot indicates that you made two selections for this category. You are only allowed to make a single selection for this category. As a consequence, your current choice for this category WILL NOT BE COUNTED. If this is not your intent or is unacceptable to you, then press the "Reject" button.

256

233

2. County Sheriff: John Wayne

Your ballot indicates that you chose the above selection for this category. If this is not your intent or is unacceptable to you, then press the "Reject" button below.

256

233

3. Proposition 219: Abstain

Your ballot indicates that you did not indicate a choice for this category. As a consequence, any choice you may wish to make for this category WILL NOT BE COUNTED. If this is not your intent or is unacceptable to you, then press the "Reject" button.

256

4. County Judge: First Selection: Lane, Lois 233

Second Selection: Abstain

Your ballot indicates that you could vote for a total of 2 candidates for this category and have only chosen 1 candidate. As a consequence, any choice you might have for a second selection in this category WILL NOT BE COUNTED. If this is not your intent or is unacceptable to you, then press the "Reject" button.

256

253

FIG. 6

VOTING BALLOT, VOTING MACHINE, AND ASSOCIATED METHODS

TECHNICAL FIELD

The present invention is generally related to the field of voting tabulation and, more particularly, is related to a low cost system and method.

BACKGROUND

The election of for President of the United States in the year 2000 uncovered serious problems with voting systems in the United States. That year, the office of the President was decided by a margin of less than 500 votes. Controversy was rampant as recounts were performed on punch cards that were used as voting ballots. The American public was dismayed as the press reported that many ballots did not accurately relay the intent of individual voters. Specifically, many voters did not punch all the way through such ballots, leaving the chads hanging on the ballot. Controversy swirled around whether various ballots should be counted or disregarded because of such voter mistakes. Perhaps the most troubling aspect of these circumstances is that the office of the presidency was decided by a margin that was much less than the number of ballots that were rejected because of voter mistakes, etc.

When the election was finally decided, America resolved to revamp her voting systems to ensure that such a situation was never repeated. In particular, a proper voting system should be much more accurate and reliable. Unfortunately, a significant number of the voting systems in the various counties in the United States employ the problematic and outdated voting technologies and should be updated. As a result, there is a significant cost to replace all outdated voting systems with sufficiently reliable voting machines. For many localities, this cost may place new and reliable voting machines out of reach.

SUMMARY

In light of the forgoing, the present invention provides for a voting ballot that comprises a number of selection areas positioned thereon. The voting ballot also includes a ballot specification embodied in a two dimensional bar code and a number of coordinates included in the ballot specification. Each of the coordinates indicates a position of one of the selection areas on the voting ballot relative to a predefined point on the voting ballot. Also, the voting ballot includes at least one contest identified in the ballot specification, wherein at least one of the selection areas is associated with the at least one contest. In addition, the present invention provides for a voting machine and method for tabulating and storing votes cast on the voting ballot as well as a system and method for creating the voting ballot.

Other features and advantages of the present invention will become apparent to a person with ordinary skill in the art in view of the following drawings and detailed description. It is intended that all such additional features and advantages be included herein within the scope of the present invention.

BRIEF DESCRIPTION OF THE SEVERAL VIEWS OF THE DRAWINGS

The invention can be understood with reference to the following drawings. The components in the drawings are not necessarily to scale. Also, in the drawings, like reference numerals designate corresponding parts throughout the several views.

FIG. 3 is a drawing of a ballot specification associated with the ballot of FIG. 1;

FIG. 6 is a drawing of a vote confirmation generated by the voting machine of FIG. 4;

DETAILED DESCRIPTION

Figure 1:
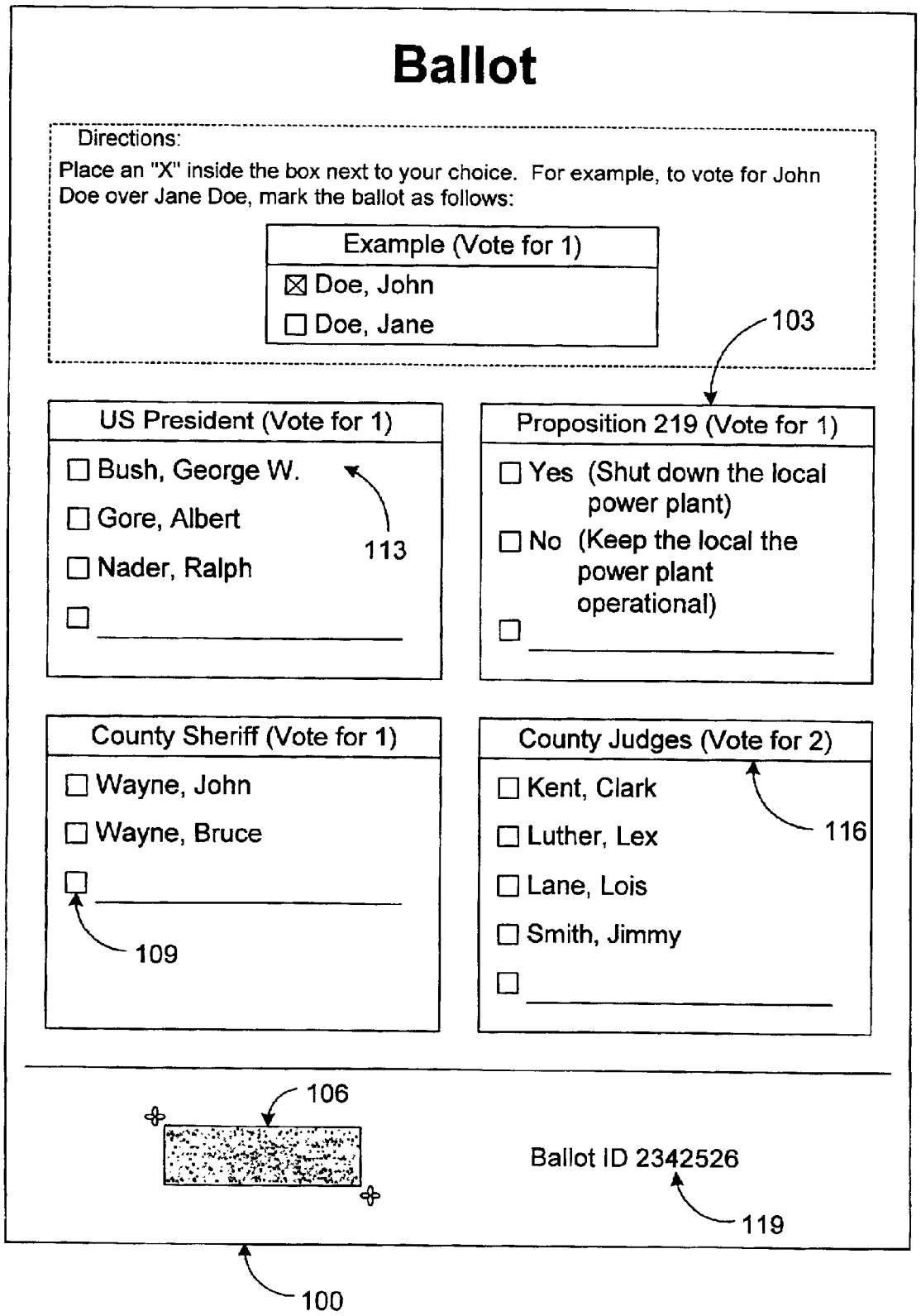
FIG. 1 is a drawing of a ballot according to an embodiment of the present invention.

With reference to FIG. 1, shown is a ballot 100 according to an aspect of the present invention. The ballot 100 includes a number of contests 103. The ballot 100 also includes a two dimensional bar code 106. Embodied within the two dimensional bar code is a ballot specification as will be described. Each of the contests 103 includes a number of selection areas 109. Associated with each of the selection areas 109 is a competitor 113. The competitors 113 may be, for example, individuals who are candidates in a particular election or the competitors 113 may be choices in an issue or proposition that is commonly presented to voters of a given region, etc. Associated with each of the contests 103 is a selection limit 116 that indicates a number of allowable choices that a voter may make for a particular contest 103. The ballot 100 also includes a ballot identifier 119 that uniquely identifies the ballot 100. Note that the ballot identifier 119 may be, for example, a combination of alphanumeric symbols, a bar code, or other identification information.

When a user wishes to cast a vote using the ballot 100, then a user will place a mark such as an "X" inside the respective selection areas 109 that reflect their choices for the given contests 103. Thereafter, the ballot 100 is scanned and the vote is tabulated as will be described.

Figure 2:
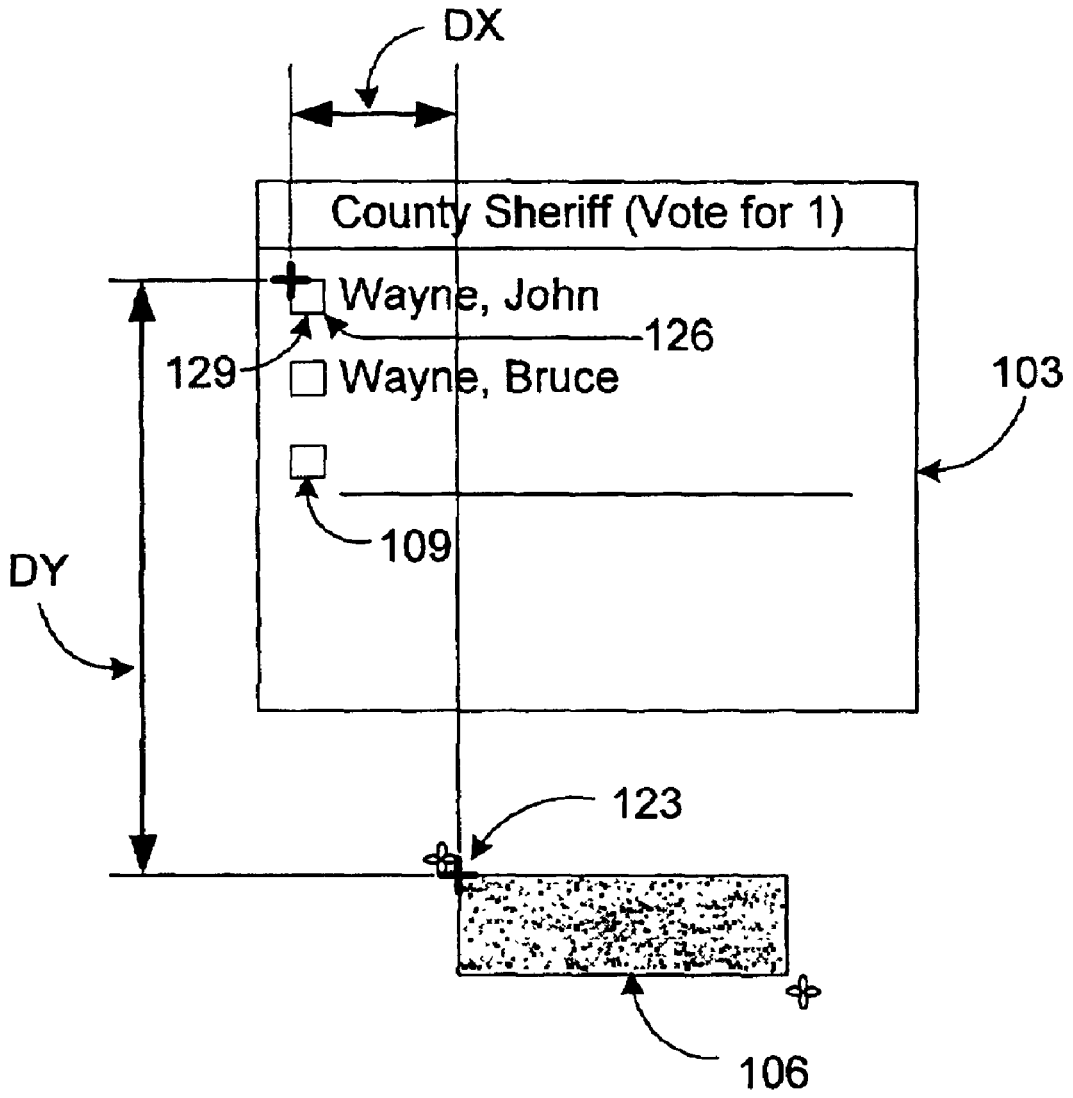
FIG. 2 is a drawing of a portion of the ballot of FIG. 1 illustrating relative distances between predefined ballot components.

With reference to FIG. 2, shown is one of the contests 103 with the respective selection areas 109 included therein. According to an aspect of the present invention, the ballot specification embodied within the two dimensional bar code 106 includes coordinates that locate a position of the respective selection areas 109 on the ballot 100 relative to a fixed point 123. As shown, the fixed point 123 is a corner of the two dimensional bar code, although the fixed point 123 may actually be any point on the ballot 100 itself. The coordinates may be expressed, for example, in rectangular coordinates including a horizontal distance DX and a vertical distance DY. Alternatively, the relative positions of the fixed point 123 and the selection area 109 may also be expressed in other coordinate systems as can be appreciated by those with ordinary skill in the art.

The selection areas 109 may be expressed in the ballot specification in terms of both shape and size. For example, given that the selection areas 109 are boxes, then the ballot specification might include a height 126 and a width 129 of the selection areas 109. Note however that other shapes may be employed such as, for example, circles, ovals, or any other shape.

Turning then to FIG. 3, shown is an example of a ballot specification 106*a* that is embodied in the two dimensional bar code 106 (FIG. 1). The ballot specification 106*a* may be expressed, for example, in terms of an Extensible Markup Language (XML) file, some other markup file or according to some other language that facilitates the expression of associations between the various elements described therein. Such languages may include, for example, those file types or languages that employ tree structures, etc.

The ballot specification 106*a* includes the ballot identifier 119 and also identifies the one or more contests 103 as shown. Associated with each of the contests 103, are competitors 113 and a selection limit 116. Note that the selection limit 116 is indicated as an attribute of a tag associated with the contest 103, although it may be expressed as a tagged item or in some other manner. Each of the contests 103 also includes a contest type 133 and a contest title 136. The contest type 133 identifies the nature of the associated contest 103. For example, a particular contest may be a race between two individuals. In such case, the contest type 133 is a "Candidate" contest type 133. Alternatively, the contest may be an issue or proposition based contest. In such a case, the contest type 133 is indicated as a "Proposition".

Associated with each of the competitors 113 are coordinates that provide the location of the respective selection area 109 associated with the respective competitor 113 on the ballot 100 (FIG. 1) relative to a fixed point 123 (FIG. 2) on the ballot. Also, the dimensions 129 of the selection area 109 (FIG. 2) are included and associated with each of the respective competitors 113. Other information in the ballot specification 106*a* may include, for example, a region type 139 that provides information as to the nature of the region in which the particular contests 103 is held. For example, in the United States, an election for the United States President might be labeled as being held in a "Federal" region whereas an election for a mayor of a particular town might be held in a "Municipal" region. In addition, a region identifier 143 may be included in the ballot specification 106*a* and associated with each of the contests 103 to identify the particular location for which the election is held. For example, in an election for the United States President, the region identifier would be the United States, where as for an election for mayor of a local municipality, the region identifier might be the name of the municipality like, Corvallis, Oreg.

Thus, the ballot specification 106*a* and other files described herein depict various elements as either tagged items or attributes, etc., arranged in a tree structure or other structure. Ultimately, such files indicate various associations between such elements. However, the specific format may vary significantly. For example, tagged items may be depicted as attributes and vice versa. Also, the tree structure may vary, thereby expressing the associations between elements in a different manner. It is understood that any such variation in the expression of such files falls within the scope of the present invention.

Figure 4:
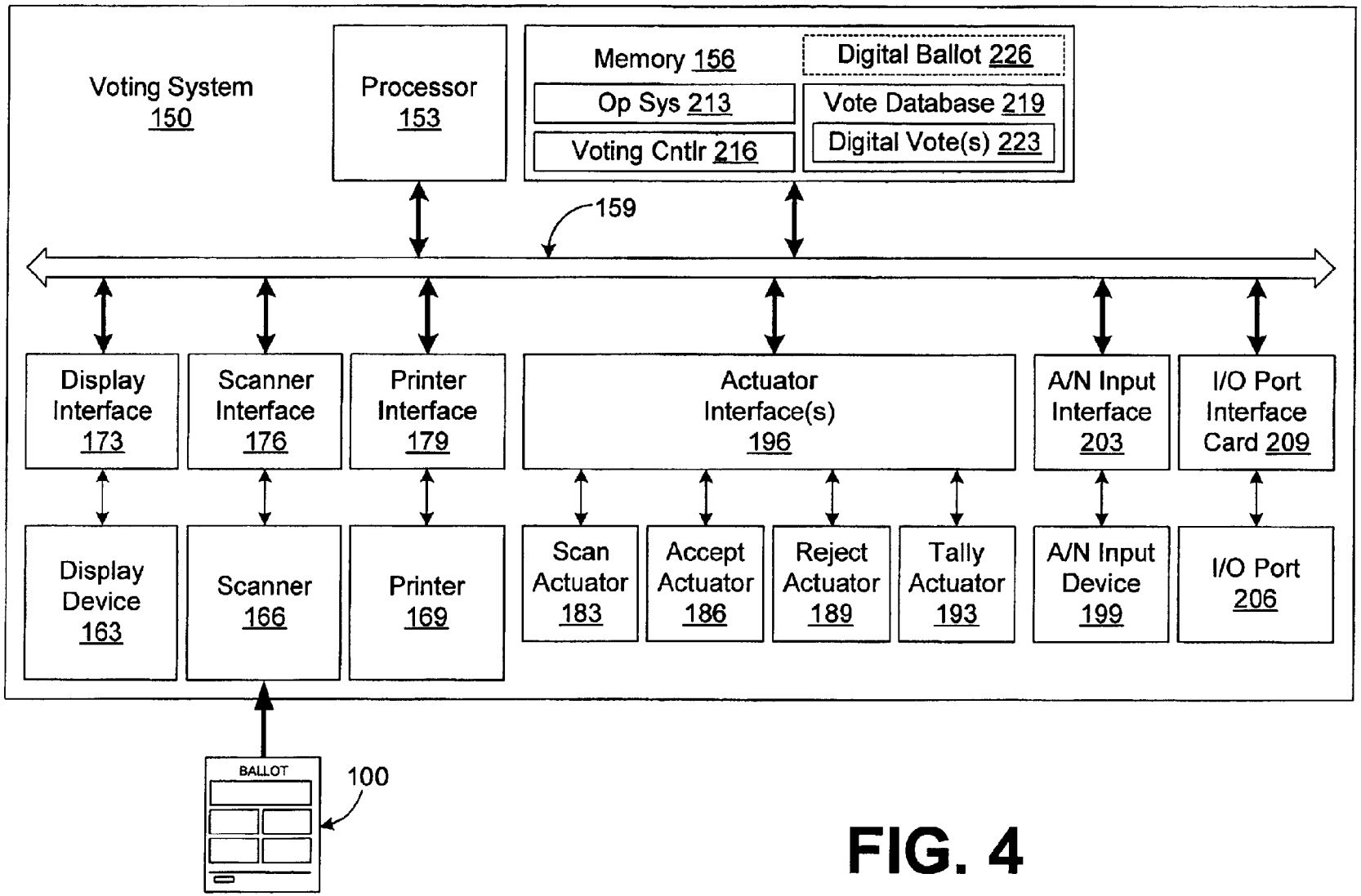
FIG. 4 is a block diagram of a voting machine that is employed to tabulate the ballot of FIG. 1 according to an embodiment of the present invention.

With respect to FIG. 4, shown is a voting system 150 according to an aspect of the present invention. The voting system 150 includes a processor circuit having a processor 153 and a memory 156, both of which are coupled to a local interface 159. The local interface 159 may comprise, for example, a data bus with an accompanying control/address bus as is generally known by those with ordinary skill in the art. In this respect, the voting system 150 may be, for example, a computer system or other system with like capability.

The voting system 150 also includes a display device 163, a scanner 166, and a printer 169. Note that the display device 163 and the printer 169 may be optional as will be discussed. The display device 163, scanner 166, and printer 169 are all coupled to the local interface 159 through a display interface 173, a scanner interface 176, and a printer interface 179, respectively. The display interface 173, scanner interface 176, and printer interface 179, may be, for example, interface cards or other circuitry that acts as a buffer between the local interface 159 and the respective display device 163, scanner 166, and printer 169 as can be appreciated by those with ordinary skill in the art. In this manner, the display interface 173, scanner interface 176, and printer interface 179 provide access to the processor 153 to the display device 163, scanner 166, and printer 169.

The voting system 150 also includes a number of actuators that may be manipulated by a user to cause the voting system 150 to perform various tasks as will be described. The specific actuators include, for example, a "scan" actuator 183, an "accept" actuator 186, a "reject" actuator 189, and a "tally" actuator 193. All of the actuators 183,186,189 and 193 are coupled to the local interface 159 through one or more actuator interfaces 196 as shown. In this respect, the manipulation of any one of the actuators 183, 186, 189 or 193 may be detected by or communicated to the processor 153 and the appropriate tasks may then be executed in response thereto. The actuators 183,186, 189 and 193 may comprise, for example, push buttons, buttons on a touch screen, or other input devices that provide a like capability that is manipulated by a user. The specific functionality that is implemented upon manipulation of one of the actuators 183, 186, 189, or 193 is discussed with reference to later figures. The voting system 150 also includes an alphanumeric input device 199 that is coupled to the local interface 159 by way of an alphanumeric input interface 203. The alphanumeric input device 199 is employed by a user to input alphanumeric information relative to the voting process as will be discussed. The alphanumeric input device 199 may be, for example, a keyboard or touch pad, etc.

The voting system 150 also includes an Input/Output (I/O) port 206 that is coupled to the local interface 159 by way of an I/O port interface card 209. The I/O port 206 provides access to the voting system 150 by external devices such as computer systems or other devices. Note that such capability may be desirable, for example, in order to export voting records from the voting system 150 to an external device or system as will be discussed.

The voting system 150 also includes a number of components stored within the memory 156 and executable by the processor 153. In particular, the voting system 150 includes an operating system 213, a voting controller 216, and a vote database 219. Stored within the vote database 219 are a number of digital votes 223. In addition, a digital ballot 226 is generated by the voting controller 216 when a ballot 100 is scanned by the scanner 166. The digital ballot 226 is thus stored in the memory 156. Alternatively, the digital ballot 226 may also be stored in a database with other digital ballots 226.

The memory 156 is defined herein as both volatile and nonvolatile memory and data storage components. Volatile components are those that do not retain data values upon loss of power. Nonvolatile components are those that retain data upon a loss of power. Thus, the memory 156 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

In addition, the processor 153 may represent multiple processors and the memory 156 may represent multiple memories that operate in parallel. In such a case, the local interface 159 may be an appropriate network that facilitates communication between any two of the multiple processors, between any processor and any one of the memories, or between any two of the memories etc. The processor 153 may be electrical or optical in nature.

The operating system 213 is executed to control the allocation and usage of hardware resources in the voting system 150 such as the memory, processing time and peripheral devices. In this manner, the operating system 213 serves as the foundation on which applications depend as is generally known by those with ordinary skill in the art.

Next, a general discussion of the operation of the voting system 150 is provided. To begin, a user obtains a ballot 100 and fills out their appropriate selections for the contests 103 (FIG. 1). Thereafter, the user scans the ballot 100 with the scanner 100 by placing the ballot 100 in the appropriate position for the scanner 166 and manipulating the scan actuator 183. Thereafter, the voting controller 216 causes the scanner 166 to scan the ballot 100 and generates the digital ballot 226 therefrom. In this respect, the digital ballot 226 is an electronic copy of the ballot 100 that may be expressed in any appropriate format such as, for example, a bitmap, image, or other format. Thereafter, the voting controller 216 analyzes the digital ballot 226 to ascertain the vote expressed therein. Specifically, the voting controller 216 analyzes both the selections indicated on the digital ballot 100 as well as the two dimensional bar code 106 (FIG. 1) to identify the particular vote expressed therein.

The voting controller 216 then generates a vote confirmation that is rendered for the user to confirm the vote that is expressed in the digital ballot 226. The vote confirmation may be rendered on the display device 163 or on the printer 169. Alternatively, the vote confirmation may be printed directly on the ballot 100 itself to indicate the vote as recognized by the voting system 150 as ascertained from the digital ballot 226. Note that it may be the case that the vote expressed on the ballot 100 is different from the vote expressed in the vote confirmation due to the fact that the voter might have made a mistake by creating stray lines on the ballot 100, etc.

The voter may then view the vote confirmation to ascertain whether the vote that was interpreted by the voting controller 216 from the digital ballot 226 actually reflects the wishes of the voter. Assuming that the voter agrees with the vote confirmation rendered to them, then the voter may manipulate the accept actuator 186. In this manner, the reliability of a vote cast using the ballot 100 is assured as the voter is given the opportunity to make sure their vote was correct.

If the accept actuator has been manipulated with respect to a particular vote confirmation, then the voting controller 216 generates a digital vote 223 that reflects the voters choices on the digital ballot 226. This digital vote 223 is then stored in the vote database 219 for future vote tallying. However, if a user has discovered that either the digital ballot 226 was interpreted incorrectly or that they made a mistake in their voting upon reviewing the vote confirmation and they wish to revote, then the user may manipulate the reject actuator 189. In response, the voting controller 216 eliminates the corresponding digital ballot 226 and therefore the vote expressed therein will be eliminated as well. The corresponding ballot 100 may then be discarded.

In addition, assuming that a user wishes to tally the digital votes 223 stored in the memory 156, then the user may manipulate to the tally actuator 193. This causes the voting controller 216 to count the various selections on the digital votes 223 and render results either on the display device 163 or on the printer 169. In this manner, an exact count of the votes contained in the voting system 150 may be obtained with little effort. The results of such a tally may be rendered, for example, on the display device 163 in an appropriate graphical user interface. Also, the results may be rendered by the printer 169, etc.

Figure 5:
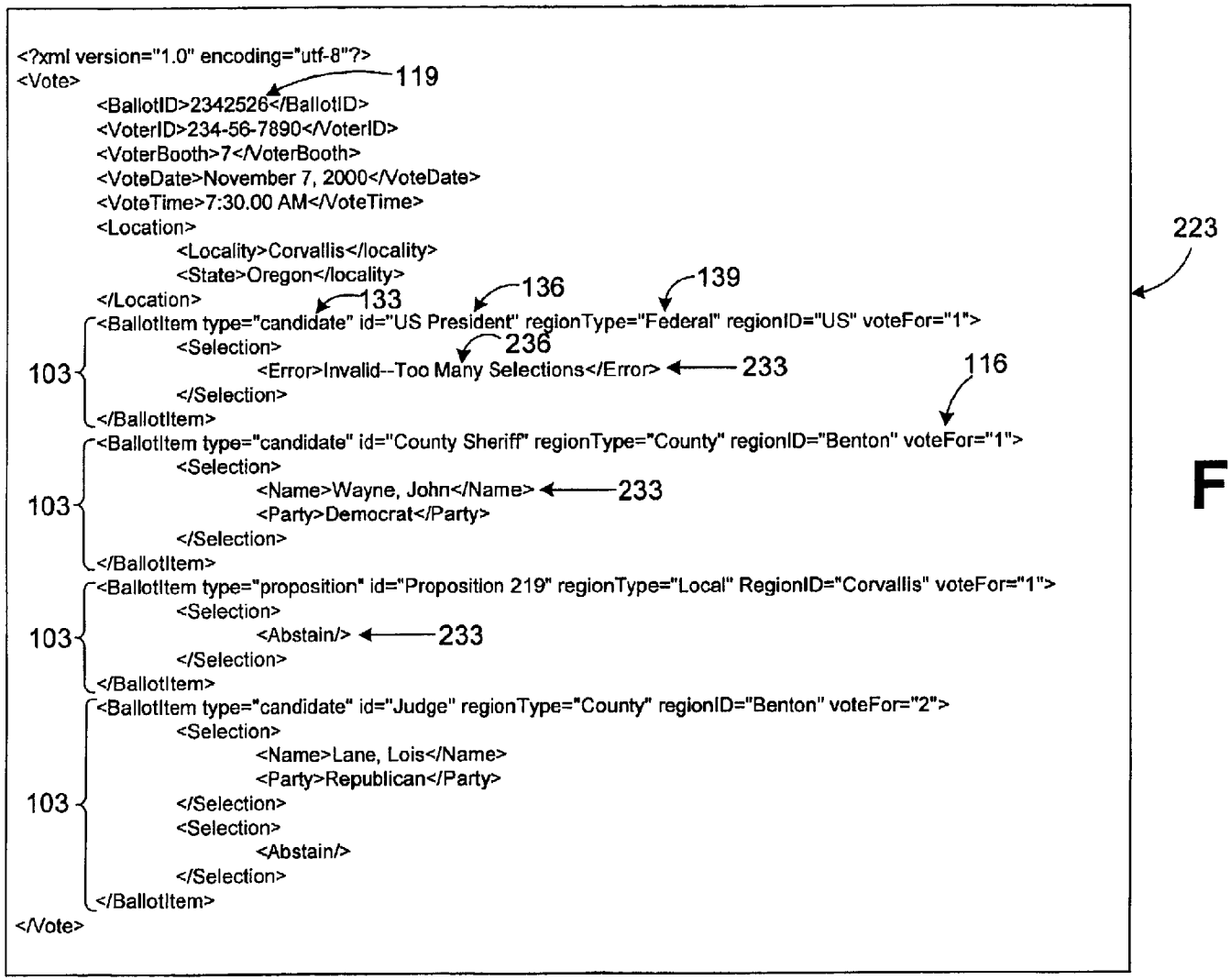
FIG. 5 is a drawing of a digital vote generated by the voting machine of FIG. 4 according to an aspect of the present invention.

With reference to FIG. 5, shown is a digital vote 223 according to an aspect of the present invention. The digital vote 223 may be expressed, for example, as an Extensible Markup Language (XML) file or in other suitable format as was described with reference to the ballot specification 106*a* (FIG. (FIG. 3). The digital vote 223 includes, for example, the ballot identifier 119 corresponding to the digital ballot 223 from which the digital vote 223 is derived. The digital vote 223 may also include logistical information related to the time, place, voter identification, and other information relative to the vote expressed in the ballot 100. The digital vote 223 also includes information relative to each of the contests 103 such as the contest type 133, contest title 136, region type 139, region identifier 143 and selection limit 116.

Associated with each of the contests 103 is a selection 233. Note that a selection 233 may include an invalidity indicator 236 in cases where the voter selections on the ballot 100 (FIG. 1) violate the rules for that contest 103. Also, "error" tags may be employed that indicate an error was made. Such may be the case, for example, when a voter votes for more than the allowed number of selections 233 in a given contest 103. The selections 233 may also include an "abstain" indicator where a voter has not indicated a selection on the ballot 100 for a respective contest 103. By expressing a digital vote in a markup language or other equivalent file type, then the voting controller 216 (FIG. 4) may then perform a tally of the votes included thereon in an expedient manner. This is due to the fact that the digital votes 223 express the information in a manner that facilitates searching and tabulation functions as can be appreciated by those with ordinary skill in the art.

With reference to FIG. 6, shown is an example of a vote confirmation 253 according to an aspect of the present invention. The vote confirmation depicts the selections 233 for the respective contests 103 as determined from a respective digital ballot 226 (FIG. 4). For each contest 103, a vote result explanation 256 may be included to indicate to a voter as to any errors or other problems that exist with their selection. Also, an invalidity indicator 236 may be included in the vote confirmation 253 that informs a user that a particular selection 233 is invalid for some reason. For example, the selection 233 for a particular contest may blink in the vote confirmation 253 that is rendered on the display device 163 (FIG. 4) to draw a voter's attention to the potential problem. The same selection might be printed in bold or in some other manner to draw attention to the potential error.

The vote result explanations 256 may be stored within the memory 156 and automatically generated in the vote confirmation based upon the selections 233 as is appropriate. The vote confirmation 253 may be rendered on the display device 163 or by the printer 169. Alternatively, the printer 169 may be employed to overwrite confirmation information on the ballot 100 itself. For example, the selections 233 interpreted by the voting controller 216 from the digital ballot 226 may be circled on the ballot 100 in a colored ink or some other indication may be employed to drawing the voter's attention thereto.

Figure 7:
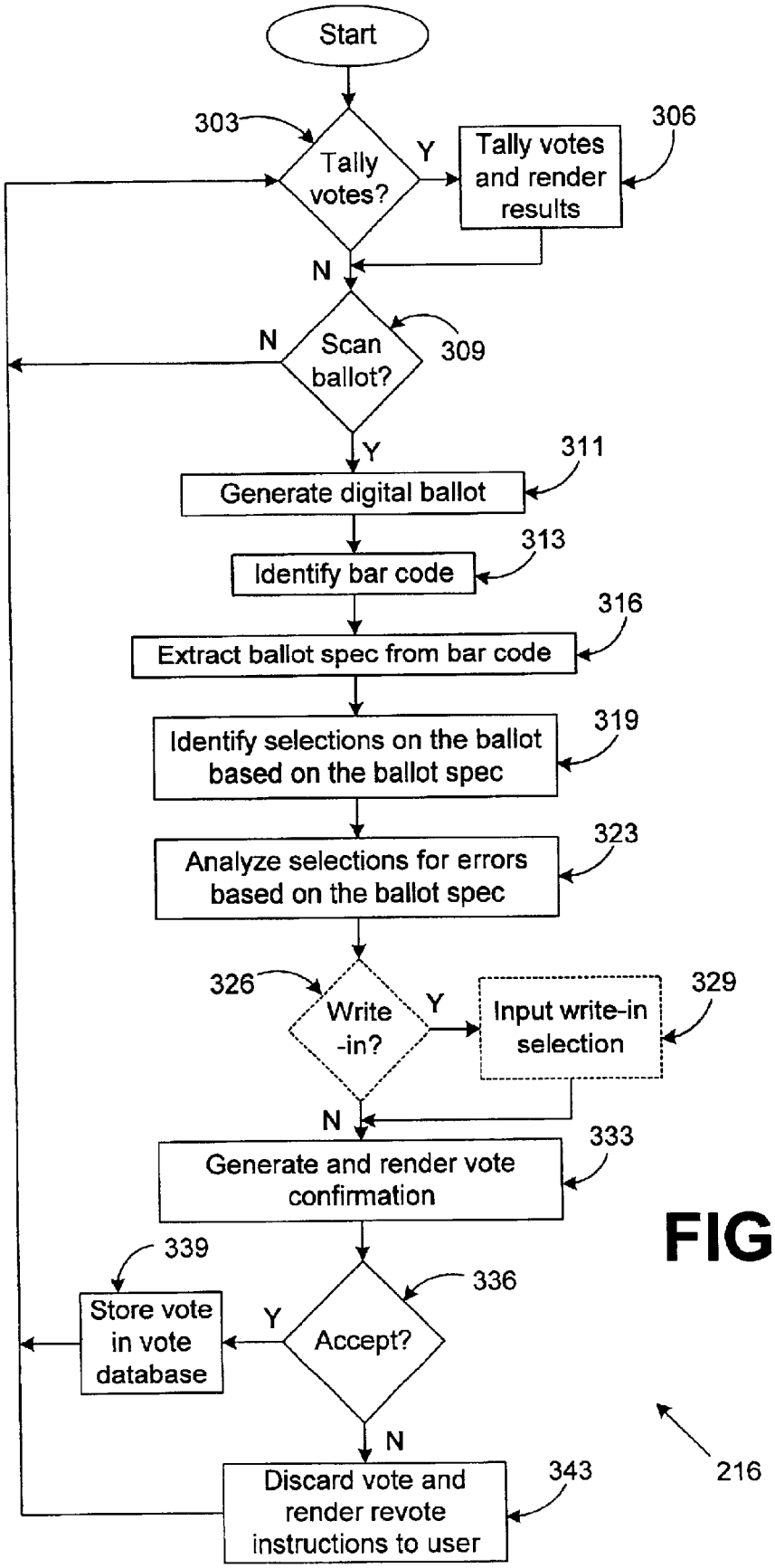
FIG. 7 is a flow chart of a voting controller executed in the voting machine of FIG. 4.

Turning then to FIG. 7, shown is a flow chart of the voting controller 216 according to an aspect of the present invention. Alternatively, the flow chart of FIG. 7 may be viewed as a method that is implemented in the voting system 150 (FIG. 4) according to an aspect of the present invention. In this respect, the voting controller 216 generally controls the functions of the voting system 150 in scanning and interpreting a vote on the ballot 100 (FIG. 1) and generating the digital vote 223 (FIG. 1) as well as performing other tasks as is described below.

Beginning with block 303, the voting controller 216 first determines whether the digital votes 223 contained within the vote database 219 are to be tallied for a final result. Such may be the case, for example, if a user manipulates the tally actuator 193 (FIG. 4). If such is the case then the voting controller 216 proceeds to box 306 in which the votes are tallied for each of the contests 103 (FIG. 1) and the results are rendered for the user. The results may be rendered either on the display device 163 (FIG. 4) or by the printer 169 (FIG. 4). If votes are not to be tallied in box 303 or if the votes have already been tallied in box 306 and rendered for the user, then the voting controller 216 proceeds to box 309.

In box 309, the voting controller 216 determines whether a ballot 100 (FIG. 1) has been scanned by the scanner 166 (FIG. 4). This may be determined, for example, by detecting whether a user has manipulated the scan actuator 183 (FIG. 4) or by detecting an appropriate message or interrupt created by the scanner 166 upon scanning of the ballot 100. If there is no scan performed, then the voting controller 216 reverts back to box 303. If a scan is performed, then the voting controller proceeds to box 311 in which the digital ballot 226 (FIG. 1) is generated. The digital ballot 226 may be expressed in terms of one of several different formats as can be appreciated by those with ordinary skill in the art. For example, the digital ballot 226 may be represented as a bitmap, image, or other similar format.

Thereafter, the voting controller 216 proceeds to box 313 in which the two dimensional bar code 106 is identified in the digital ballot 226. In this respect, both the ballot 100 and the digital ballot 226 include bar code identification indicia that is recognizable by the voting controller 216 that indicates the precise location of the two dimensional bar code 106 on the ballot 100. Then, in box 316, the two dimensional bar code 106 is converted into the ballot specification 106*a* (FIG. 3). Thus, the ballot specification 106*a* is embodied in the form of the two dimensional bar code 106 that is obtained from the digital ballot 226 and stored on the memory 156 (FIG. 4). Thereafter, in box 319 the voting controller 216 identifies the selections 233 (FIG. 5) that are indicated on the digital ballot 226. Then, in box 323, the voting controller 216 analyzes these selections 233 for any errors or other problems based upon the information set forth in the ballot specification 106*a* (FIG. 3).

In order to determine whether an error exists on the digital ballot 226, the voting controller 216 determines the requirements for each of the contests 103 and then compares such requirements with the actual vote expressed on the digital ballot 226. For example, where a ballot specification 106*a* indicates that a voter is only to make one selection, the voting controller 216 then examines whether the digital ballot 226 indicates more than one selection for the particular contest 103, etc.

Thereafter, in box 326, it is determined whether any one of the selections in the digital ballot 226 is a write-in selection such that the voter has identified a specific party not listed in the contest 103 for whom they wish to vote. If such is the case, then the voting controller 216 proceeds to box 329 in which the write-in selection may be input using the alpha-numeric input device 199 (FIG. 4). The voting controller 216 then includes such information in the corresponding digital vote 223 accordingly.

Assuming that there is no write-in candidate or that the write-in candidate has been entered, then the voting controller proceeds to box 333. In box 333, the vote confirmation 253 (FIG. 6) is generated and rendered for the user so that they may confirm that the vote interpreted from the ballot 100 by the voting controller 216 is correct and accurately reflects their intent. Then, in box 336, the voting controller 216 determines whether the vote is to be accepted or rejected based upon the user's scrutiny of the vote confirmation 253. This is determined, for example, by whether the user manipulates the accept actuator 186 (FIG. 4) or the reject actuator 189 (FIG. 4).

Assuming that the vote is to be accepted, then the voting controller 216 proceeds to box 339 in which the digital vote 223 corresponding to the vote determined from the digital ballot 226 is stored in the vote database 219 (FIG. 4). Thereafter, the voting controller 216 reverts back to box 303. On the other hand, if the user rejects the vote as inaccurate or not in accord with their intent, then the voting controller proceeds to box 343 in which the vote is discarded and instructions are rendered either on the display device 163 or the printer 169 for the voter to cast a revote. Thereafter, the voting controller 216 reverts back to box 303.

Figure 8:
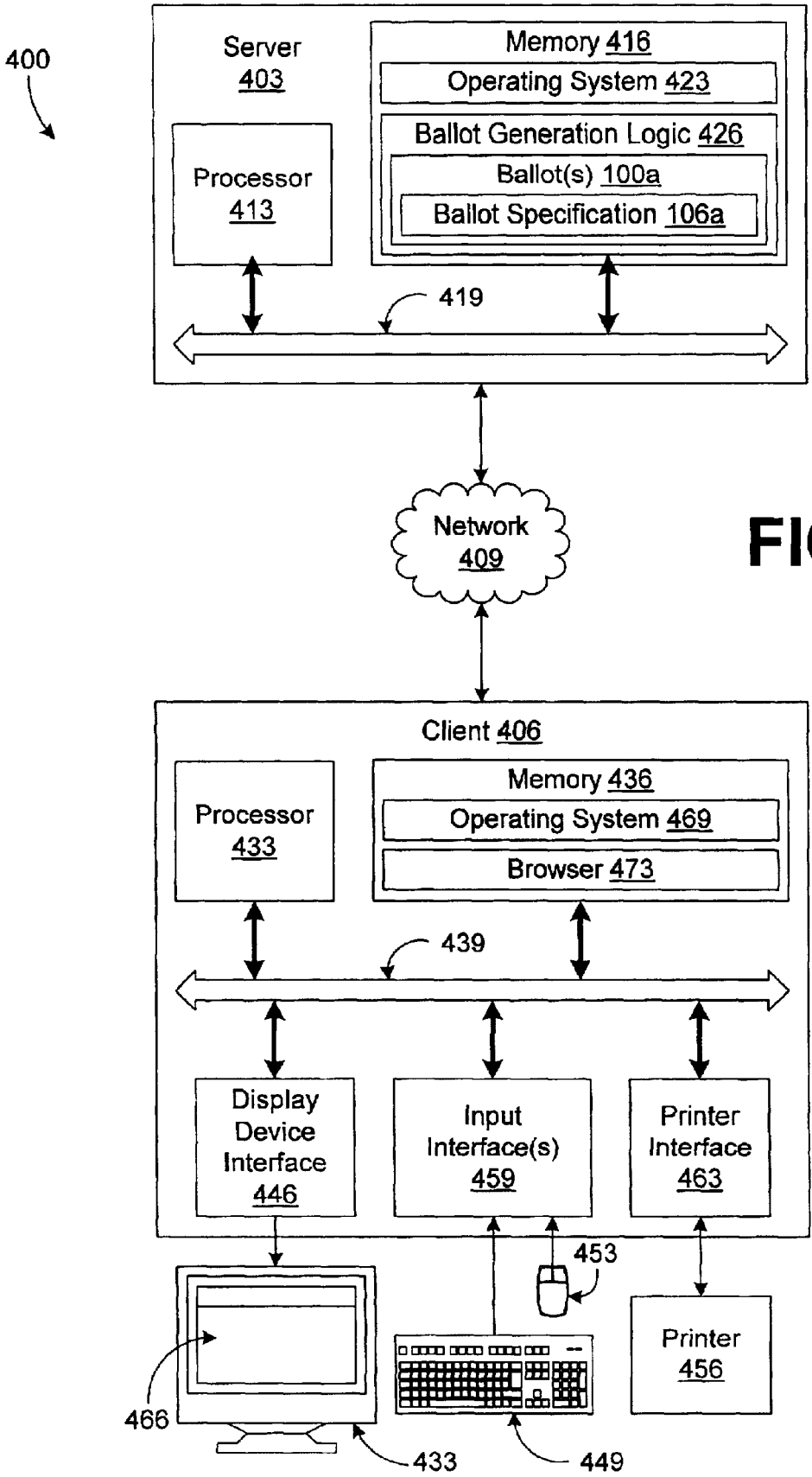
FIG. 8 is a block diagram of a ballot generation system used to create the ballot of FIG. 1 according to an embodiment of the present invention.

With respect to FIG. 8, shown is a ballot generation network 400 according to an embodiment of the present invention. The ballot generation network 400 includes a server 403 and a client 406, both of which are coupled to a network 409.

The network 409 includes, for example, the Internet, intranets, wide area networks (WANs), local area networks, wireless networks, or other suitable networks, etc., or any combination of two or more such networks. Both the server 403 and client 406 are coupled to the network 409 in such a manner so as to facilitate data communication between each other over the network 409. In this respect, the server 403 and client 406 may each be linked to the network 409 through various devices such as, for example, network cards, modems, or other such communications devices.

The server 403 includes a processor circuit having a processor 413 and a memory 416, both of which are coupled to a local interface 419. The local interface 419 may be, for example, a data bus with an accompanying control/address bus as is generally understood by those with ordinary skill in the art. In this respect, the server 403 may be, for example, a computer system or other apparatus with like capability. The server 403 may include various peripheral devices such as, for example, a keyboard, keypad, touch pad, touch screen, microphone, scanner, mouse, joystick, or one or more push buttons, etc. The peripheral devices may also include display devices, indicator lights, speakers, printers, etc. Specific display devices may be, for example, cathode ray tubes (CRTs), liquid crystal display screens, gas plasma-based flat panel displays, or other types of display devices, etc.

Stored on the memory 416 and executable by the processor 413 is an operating system 423 and ballot generation logic 426. The ballot generation logic 426 is executed by the processor 413 to generate one or more ballots 100*a*. Each of the ballots 100*a* includes a ballot specification 106*a*. Note that the ballots 100*a* are blank in that they have not been filled or otherwise marked by a particular voter. The operating system 423 is executed to control the allocation and usage of hardware resources in the server 403 such as the memory, processing time and peripheral devices. In this manner, the operating system 423 serves as the foundation on which applications depend as is generally known by those with ordinary skill in the art.

The client 406 includes a processor circuit having a processor 433 and a memory 436, both of which are coupled to a local interface 439. The local interface 439 may be, for example, a data bus with an accompanying control/address bus as is generally understood by those with ordinary skill in the art. In this respect, the client 406 may be, for example, a computer system or other apparatus with like capability. The client 406 includes a display device 443 that is coupled to the local interface 439 through a display device interface 446.

In addition, the client 406 includes a keyboard 449, a mouse 453, and a printer 456. The keyboard 449 and mouse 453 are coupled to the local interface 439 through appropriate input interfaces 459. Likewise, the printer 456 is coupled to the local interface 439 by way of a printer interface 463. In this respect, the display device interface 446, input interfaces 459, and printer interface 463 may comprise, for example, various interface cards or other devices of like capability. The client 406 may also include other peripheral devices similar to those described above with respect to the server 403.

The client 406 also includes and operating system 469 and a browser 473 that are stored in the memory 436 and are executable by the processor 433. The operating system 469 performs various tasks in the client 406 similar to those performed by the operating system 426 of the server 403. The browser 473 provides the user with the ability to view HyperText Markup Language (HTML) files, Extensible Markup Files (XML) or other files as well as accessing software related to such files as is generally understood by those with ordinary skill in the art. In the context of the ballot generation network 400, the browser 473 provides a user with the ability to interface with the ballot generation logic 426 as will be described.

The ballot generation logic 426 is executed to generate the ballot 100 (FIG. 1) that is provided to voters with which to cast a vote. In this respect, the ballot generation logic 426 may be, for example, a web application as is typically found on the world wide web that is accessible via the browser 473. Specifically, the user may manipulate the browser 473 to interface with the ballot generation logic 426 to depict various graphical user interfaces 466 on the display device 433 in interfacing with the ballot generation logic 426. Thus, the ballot generation logic 426 may generate various web pages using Hypertext Markup Language (HTML), Extensible Markup Language (XML), or other appropriate language. Alternatively, the ballot generation logic 449 may also be stored in the memory 436 of the client 406 and executed by the processor 433.

The memories 416 and 436 are defined herein as both volatile and nonvolatile memory and data storage components. Volatile components are those that do not retain data values upon loss of power. Nonvolatile components are those that retain data upon a loss of power. Thus, the memories 416 and 436 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, each of the processors 413 and 433 may represent multiple processors and each of the memories 416 and 436 may represent multiple memories that operate in parallel processing circuits, respectively. In such a case, each of the local interfaces 419 and 439 may be an appropriate network that facilitates communication between any two of the multiple processors, between any processor and any of the memories, or between any two of the memories, etc. The processors 413 and 433 may be electrical or optical in nature.

Figure 9:
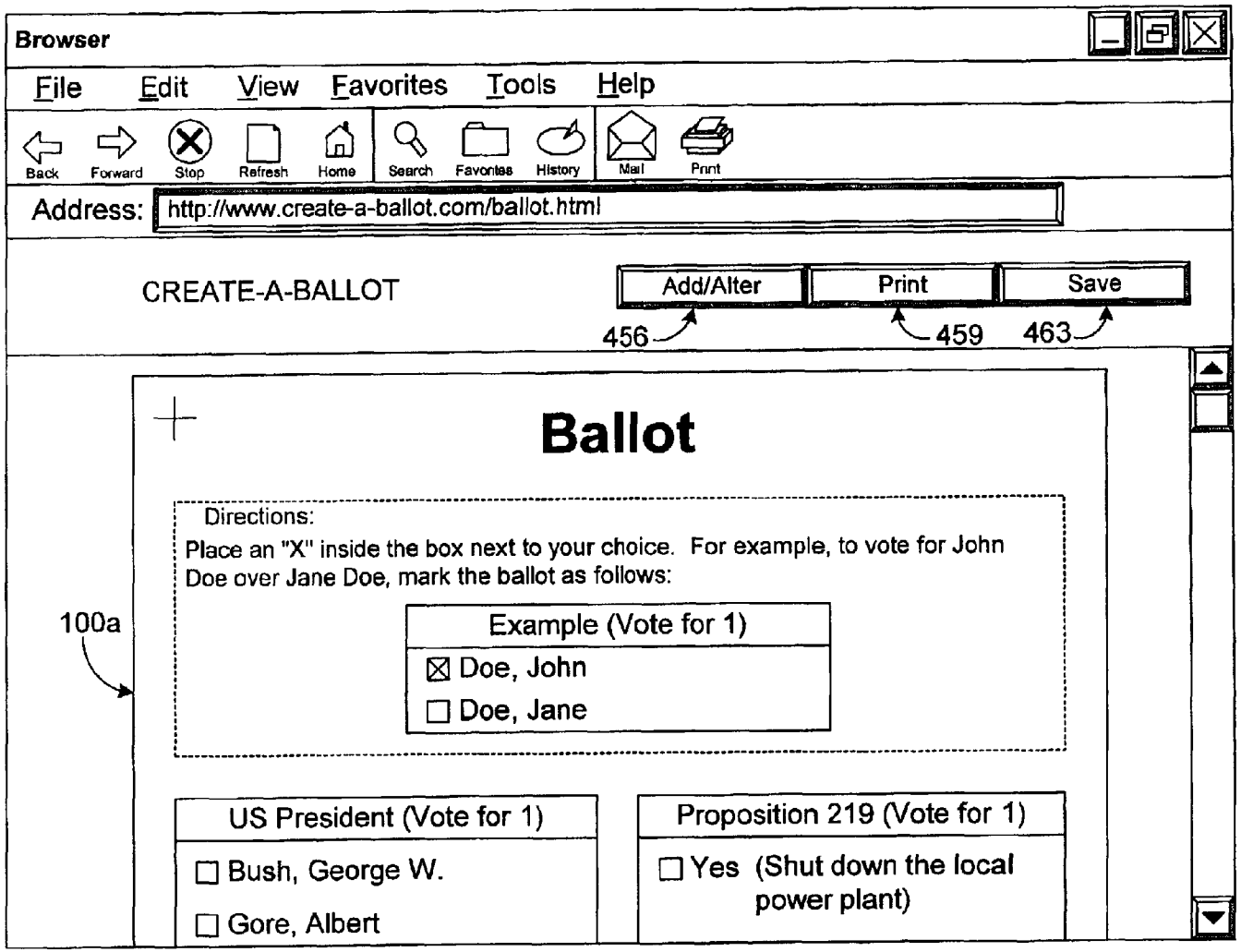
FIG. 9 is a drawing of a graphical user interface generated by the ballot generation system of FIG. 8.

With reference to FIG. 9, shown is a graphical user interface that comprises a ballot interface screen 453*a* generated by the ballot generation logic 449 (FIG. 8) that is rendered on the display device 413 (FIG. 8) by the browser 446 (FIG. 8) to generate a respective ballot 100*a*. The ballot interface screen 453*a* depicts the ballot 100*a* along with various actuators that may be manipulated by a user in order to perform various functions with regard to the ballot 100*a*. For example, the ballot interface screen 453*a* includes an "Add/Alter" manipulator 456, a "Print" actuator 459, and a "Save" actuator 463.

The manipulators 456, 459, and 463 may be, for example, graphical buttons that are manipulated by positioning a cursor thereon and then pressing a button on the mouse 423 (FIG. 8) as can be appreciated by those with ordinary skill in the art. Such action is defined as "clicking" on the button or other manipulator. The Add/Alter actuator 456 is manipulated by a user in order to add a contest 103 (FIG. 1) to the ballot 100*a* or to alter an existing contest 103 on the ballot 100*a*. The Print actuator 459 is manipulated to print the ballot 100*a* on an appropriate printing device such as the printer 426 (FIG. 4). The Save actuator 463 is manipulated by a user in order to save the ballot 100*a* at a predetermined memory location such as the memory 406 (FIG. 8) for future use. Note that the ballot interface screen 453*a* depicted by the browser 446 may be a web page, for example, generated using HTML or XML as can be appreciated by those with ordinary skill in the art.

Figure 10:
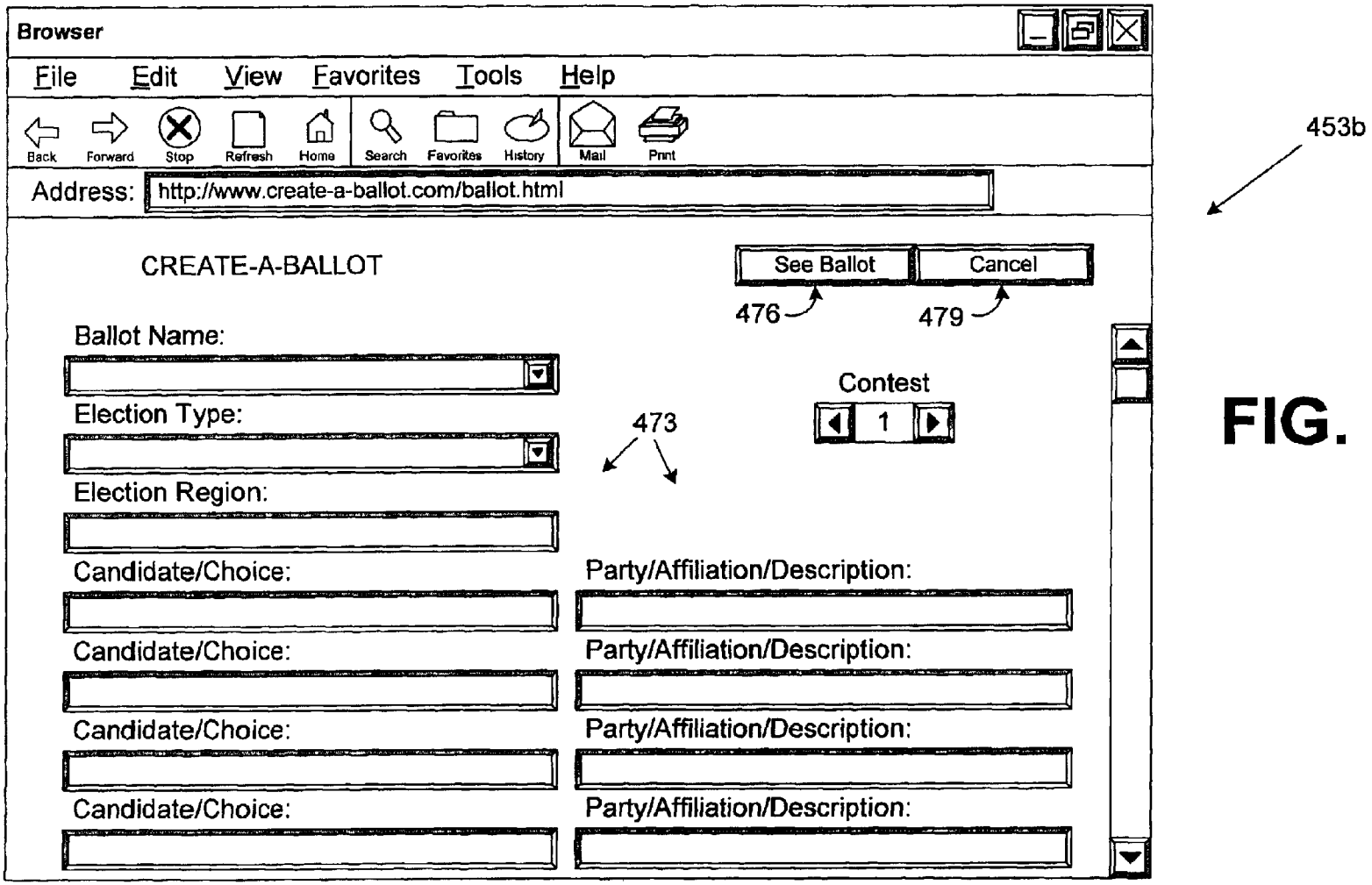
FIG. 10 is a drawing of a second graphical user interface generated by the ballot generation system of FIG. 8.

With reference to FIG. 10, shown is a second graphical user interface that comprises a ballot input screen 453*b* that allows a user to input information relative to one or more contests 103 (FIG. 1) that are to be included in the ballot 100*a* (FIG. 9). In this respect, several fields 473 are provided in to which a user may input the relative information. A "See Ballot" actuator 476 is provided in the ballot input screen 453*b* that causes the ballot generation logic 449 (FIG. 8) to revert back to the ballot interface screen 453*a* (FIG. 9) to view the resulting ballot 100*a* with any added or alte red contests 103. In this respect, any entries entered in the fields 473 are included into the ballot 100*a*. Additional fields 473 may be revealed by scrolling down as shown. A "Cancel" actuator 479 is also provided that causes the ballot generation logic 449 (FIG. 8) to revert back to the ballot interface screen 453*a* (FIG. 9) to view the resulting ballot 100*a* without any added or altered contests 103.

Figure 11:
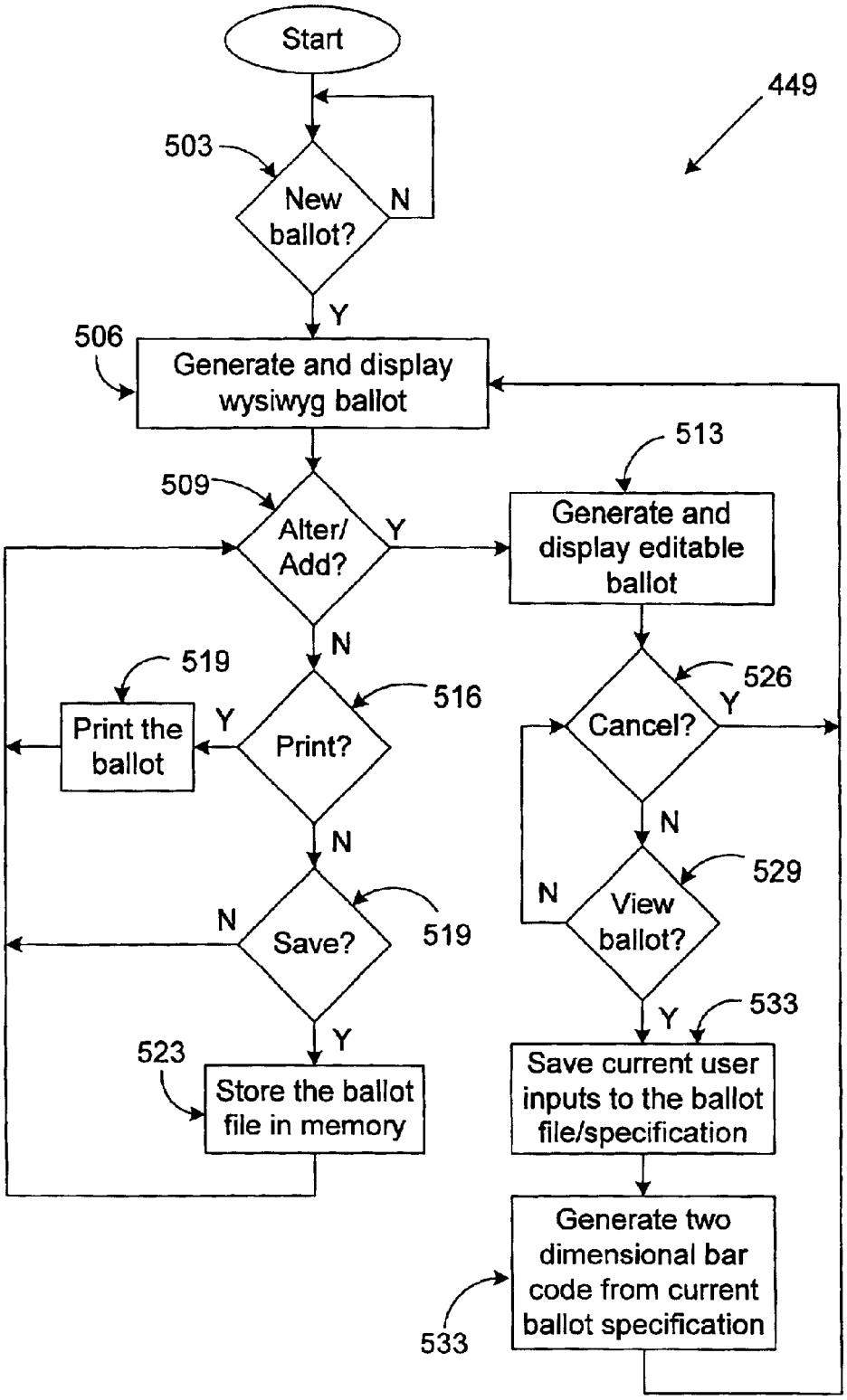
FIG. 11 is a flow chart of ballot generation logic executed in the ballot generation system of FIG. 8.

With reference to FIG. 11, shown is a flow chart of the ballot generation logic 449 according to an aspect of the present invention. Alternatively, the flow chart of FIG. 11 may be viewed as depicting steps in a method implemented in the ballot generation system 400 (FIG. 8). The ballot generation logic 449 is implemented in the ballot generation system 400 in order to generate the ballots 100*a* that may be printed out on the printer 426 (FIG. 8) for use in, for example, an election or other proceeding.

Beginning with block 503, the ballot generation logic 449 is idle until a new ballot 100*a* (FIG. 8) is to be created or an existing ballot 100*a* is to be accessed for alterations, etc. Assuming either one of these to be the case, then the ballot generation logic 449 proceeds to box 506 in which the ballot interface screen 453*a* (FIG. 9) is generated and displayed on the display device 413. The ballot interface screen 453*a* provides a "what you see is what you get"("wysiwyg") depiction of the ballot 100*a*. To accomplish this, the ballot generation logic 449 may act as an HTTP server and a user may manipulate the browser 446 (FIG. 8) to access HTML files or other files that are generated by the ballot generation logic 449. In particular, the ballot generation logic 449 generates the ballot interface screen 453*a* as a web page, although the ballot generation logic may be implemented as a system other than a World Wide Web application.

Thereafter, the ballot generation logic 449 proceeds to box 509 in which it is determined whether the user wishes to add or alter a contest 103 (FIG. 1) within or to the ballot 100*a* (FIG. 9). If so, then the ballot generation logic 449 proceeds to box 513. This may be determined, for example, when a request to alter or add a contest 103 generated upon the manipulation of the Add/Alter button 456 (FIG. 9) of the ballot interface screen 453*a*.

Otherwise, the ballot generation logic 449 moves to box 516. Assuming that the ballot generation logic 449 has proceeded to box 516, then it is determined whether the user wishes to print the current ballot 100*a* that is displayed in the ballot interface screen 453*a*. This may be determined, for example, when a clicks on the print actuator 459 (FIG. 9) of the ballot interface screen 453*a*. Assuming that the ballot 100*a* is to be printed, then the ballot generation logic 449 proceeds to box 519 in which the ballot 100*a* is printed on the printer 426 (FIG. 8). However, if the ballot is not to be printed in box 516, then the ballot generation logic 449 proceeds to box 519.

In box 519, the ballot generation logic 449 determines whether the ballot 100*a* is to be saved in the memory 406 for future access or use. This is determined, for example, when the user clicks on the save actuator 463 (FIG. 9). In saving the ballot 100*a*, the corresponding ballot specification 106*a* (FIG. 8) is saved as well. The ballot 100*a* may be saved in the memory 406 or the memory of a computer system in communication with the ballot generation server 400 via a network as can be appreciated by those with ordinary skill in the art. During the save operation, the ballot 100*a* may be embodied in any one of a number of known digital formats such as, for example, portable document format (PDF) or other format, etc. Also, the ballot may be saved in a form that is accessible by the ballot generation logic 449 so that it may be altered in the future. The precise format into which the ballot is saved may be selected during the save operation as can be appreciated by those with ordinary skill in the art.

If the ballot 100*a* is not to be saved, then the ballot generation logic 449 reverts back to box 509. Otherwise, the ballot generation logic 449 proceeds to box 523. In box 523, the ballot 100*a* may stored in the memory 406 or in the memory of another computer system or other device that is linked to the ballot generation system 400 via a network, etc. Thereafter, the ballot generation logic 449 reverts back to box 509.

Reverting back to box 513, assuming that a user wishes to alter or add a contest 103 in the ballot 100*a* in box 509, then the ballot generation logic proceeds to box 513. In box 513, the ballot input screen 453*b* is generated by the ballot generation logic 449 and rendered on the display device 413. The ballot generation logic 449 provides various fields that depict the contents of the ballot 100*a* in editable form. The ballot input screen 453*b* provides a user with an ability to view the information relative to the various contests 103 that are associated with the particular ballot 100*a*. A contest toggle device is included in the ballot input screen 453*b* with which a user may toggle between the various contests to reveal the information associated therewith.

Then, in box 526, the ballot generation logic 449 determines whether the ballot interface screen 453*a* is to be viewed upon a manipulation of the cancel actuator 473 (FIG. 10). If the user clicks thereon, then the ballot generation logic 449 reverts back to box 506. This is done without saving any of the changes or new information that is depicted by the ballot input screen 453*b* as it is assumed that such information is to be rejected. However, assuming that the cancel actuator 479 (453*b*) has not been manipulated in box 526, then the ballot generation logic 449 proceeds to box 529 in which it is determined whether the "See Ballot" actuator 476 has been clicked on by the user. If such is the case, then the ballot generation logic 449 proceeds to box 533. Otherwise, the ballot generation logic 449 reverts back to box 526. Thus, the ballot generation logic 449 displays the ballot input screen 453*b* and waits for the user to act upon any information entered therein by clicking on the See Ballot actuator 476 or the cancel actuator 479.

Assuming that a user has clicked on the See Ballot actuator 476 in box 529, then the ballot generation logic 449 proceeds to box 533. In essence, the ballot generation logic 449 ultimately reverts back to 506 after having updated the ballot specification 106*a* in light of any new contest information entered in the ballot input screen 453*b*. Thus, in box 533, the ballot generation logic 449 saves the current user inputs indicated in the ballot input screen 453*b* in the memory 406. Thereafter, the ballot generation logic 449 proceeds to box 536 in which the corresponding two dimensional bar code 106 is generated from the current ballot specification 106*a* and is also stored in the memory 406 and is associated with the corresponding ballot 100*a*. This is done so that ultimately the user may print out the ballot with the new two dimensional bar code thereon. Thereafter, the ballot generation logic 449 reverts back to box 506 as shown.

If the ballot generation logic 449 is implemented in a client-server environment where a user manipulates a browser 446 to enter the information included therein, then the ballot generation logic 449 may actually comprise a number of servlets that respond to various requests generated when the user manipulates the various actuators in the ballot interface screen 453*a* and the ballot input screen 453*b*.

Although both the voting controller 216 (FIG. 7) and the ballot generation logic 449 (FIG. 11) of the present invention are embodied in software or code executed by general purpose hardware as discussed above, as an alternative they may also be embodied in dedicated hardware or a combination of software/general purpose hardware and dedicated hardware. If embodied in dedicated hardware, the voting controller 216 and the ballot generation logic 449 each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc. Such technologies are generally well known by those skilled in the art and, consequently, are not described in detail herein.

The flow charts of FIGS. 7 and 11 show the architecture, functionality, and operation of implementations of the voting controller 216 and the ballot generation logic 449. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s).

Although the flow charts of FIGS. 7 and 11 show a specific order of execution, it is understood that the order of execution may differ from that which is depicted. For example, the order of execution of two or more blocks may be scrambled relative to the order shown. Also, two or more blocks shown in succession in FIGS. 7 and 11 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present invention. Also, the flow charts of FIGS. 7 and 11 are relatively self-explanatory and are understood by those with ordinary skill in the art to the extent that software and/or hardware can be created by one with ordinary skill in the art to carry out the various logical functions as described herein.

Also, where the voting controller 216 and the ballot generation logic 449 comprise software or code, both may be embodied in any computer-readable medium for use by or in connection with an instruction execution system such as, for example, a processor in a computer system or other system. In this sense, the logic may comprise, for example, statements including instructions and declarations that can be fetched from the computer-readable medium and executed by the instruction execution system. In the context of the present invention, a "computer-readable medium" can be any medium that can contain, store, or maintain the voting controller 216 and the ballot generation logic 449 for use by or in connection with the instruction execution system. The computer readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, or compact discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Although the invention is shown and described with respect to certain preferred embodiments, it is obvious that equivalents and modifications will occur to others skilled in the art upon the reading and understanding of the specification. The present invention includes all such equivalents and modifications, and is limited only by the scope of the claims.

We claim:

1. A voting system, comprising:

a processor circuit having a processor and a memory;

a scanner coupled to the processor circuit, the scanner being capable of scanning a ballot to generate a digital ballot therefrom, the digital ballot comprising an electronic image of the ballot and including at least one voter selection;

vote interpretation logic stored in the memory and executable by the processor, the vote interpretation logic comprising:

logic that obtains a ballot specification embodied in a two dimensional bar code included in the digital ballot, the ballot specification being associated with the digital ballot; and logic that ascertains a vote expressed in the digital ballot based upon the ballot specification and the at least one voter selection indicated in the digital ballot.

2. The voting system of claim 1, wherein the vote interpretation logic further comprises logic that generates a digital vote that embodies the vote expressed in the digital ballot.

3. The voting system of claim 2, wherein the vote interpretation logic further comprises logic that tallies a number of digital votes stored in the memory, thereby generating an election result.

4. The voting system of claim 2, further comprising:

a vote accept actuator coupled to the processor circuit; and a vote reject actuator coupled to the processor circuit.

5. The voting system of claim 4, wherein the vote interpretation logic further comprises:

logic that stores the digital vote embodying the vote in the memory upon a manipulation of the vote accept actuator; and logic that discards the digital vote upon a manipulation of the vote reject actuator.

6. The voting system of claim 1, wherein the vote interpretation logic further comprises logic that generates and renders a vote confirmation that depicts the vote interpreted from the digital ballot, thereby providing a voter with an opportunity to review the vote.

7. The voting system of claim 6, wherein the logic that generates and renders the vote confirmation that depicts the vote interpreted from the digital ballot further comprises logic that generates and renders a selection invalidity indicator within the vote confirmation that indicates an invalid selection in the vote.

8. The voting system of claim 6, further comprising:

a display device coupled to the processor circuit; and wherein the logic that generates and renders the vote confirmation that depicts the vote interpreted from the digital ballot further comprises logic that renders the vote confirmation on the display device.

9. The voting system of claim 6, further comprising:

a printing device coupled to the processor circuit; and wherein the logic that generates and renders the vote confirmation that depicts the vote interpreted from the digital ballot further comprises logic that directs the printing device to highlight the vote as expressed in the digital ballot on the ballot.

10. A voting system, comprising:

a processor circuit having a processor and a memory;

a scanner coupled to the processor circuit, the scanner being capable of scanning a ballot to generate a digital ballot therefrom, the digital ballot comprising an electronic image of the ballot and including at least one voter selection;

a vote accept actuator coupled to the processor circuit;

a vote reject actuator coupled to the processor circuit;

vote interpretation logic stored in the memory and executable by the processor, the vote interpretation logic comprising:

logic that obtains a ballot specification embodied in a two dimensional bar code included in the digital ballot, the ballot specification being associated with the digital ballot;

logic that ascertains a vote expressed in the digital ballot based upon the ballot specification and the at least one voter selection indicated in the digital ballot;

logic that generates a digital vote that embodies the vote expressed in the digital ballot;

logic that generates and renders a vote confirmation that depicts the vote ascertained from the digital ballot, thereby providing a voter with an opportunity to review the vote;

logic that stores the digital vote embodying the vote in the memory upon a manipulation of the vote accept actuator, and logic that discards the digital vote upon a manipulation of the vote reject actuator.

* * * * *